United States Patent [19]

Orlandi

[11] Patent Number: 4,574,938

[45] Date of Patent: Mar. 11, 1986

[54] BUFFER MAGAZINE FOR ROD-LIKE ARTICLES

[75] Inventor: Giancarlo Orlandi, Bologna, Italy

[73] Assignee: Sasib S.p.A., Bologna, Italy

[21] Appl. No.: 564,738

[22] Filed: Dec. 22, 1983

[30] Foreign Application Priority Data

Dec. 23, 1982 [IT] Italy ..... 12694 A/82

[51] Int. Cl.[4] ..... B65G 1/00

[52] U.S. Cl. ..... 198/347; 198/592

[58] Field of Search ..... 198/347, 535, 557, 547, 198/592, 862, 865, 457, 951; 131/282, 283; 414/30, 28

[56] References Cited

U.S. PATENT DOCUMENTS

| | | | |
|---|---|---|---|
| 1,906,098 | 4/1933 | Pullen et al. | 221/236 |
| 1,989,378 | 1/1935 | Pullen | 198/347 |
| 3,224,557 | 12/1965 | Beecher | 198/535 |
| 3,348,678 | 10/1967 | Flowers | 198/592 |
| 3,578,181 | 5/1971 | Hughes et al. | 414/30 |
| 3,659,727 | 5/1972 | Pearsall | 414/30 |
| 3,885,683 | 5/1975 | Bornfleth et al. | 198/347 |
| 3,908,985 | 9/1975 | Wiseman | 271/189 |
| 3,952,854 | 4/1976 | Selonke et al. | 198/347 |
| 3,980,174 | 9/1976 | Conrad | 198/835 |
| 4,008,801 | 2/1977 | Reilly et al. | 198/841 |
| 4,344,445 | 8/1982 | Seragnoli | 131/282 |

FOREIGN PATENT DOCUMENTS 2848817 5/1979 Fed. Rep. of Germany ..... 198/457

*Primary Examiner*—Joseph E. Valenza
*Assistant Examiner*—Kyle E. Shane
*Attorney, Agent, or Firm*—Spencer & Frank

[57] ABSTRACT

A buffer magazine includes a conveyor belt (3) of reversible type and including a horizontal stretch (103) carrying the cigarettes arranged crosswise thereto in superposed layers, and moving between two vertical side walls (2) on a supporting table (8). The horizontal cigarette-carrying stretch (103) of the conveyor belt (3) has associated therewith a transverse partition wall (7) extending upwardly between the two side walls (2) and moving, through corresponding movements of the conveyor belt (3), alternately away from the inlet of the magazine to increase the capacity of the magazine and store cigarettes, and toward the inlet of said magazine to reduce the capacity of the magazine and return stored cigarettes. The supporting table (8) of the horizontal cigarette-carrying stretch (103) of the conveyor belt (3) is inclined or adapted to be inclined to the horizontal transversely to the longitudinal direction of the cigarette-carrying stretch (103) of the conveyor belt (3) and oppositely to the transverse inclination which the filter-tipped cigarettes (S) tend to assume on said cigarette-carrying stretch (103) of the conveyor belt (3), so as to ensure an average compensation for said inclination.

7 Claims, 3 Drawing Figures

BUFFER MAGAZINE FOR ROD-LIKE ARTICLES

BACKGROUND AND SUMMARY OF THE INVENTION

This invention relates to buffer magazines for installations supplying rod-like articles, particularly filter-tipped cigarettes from one or more cigarette-making machines to one or more packing machines, said buffer magazines comprising a conveyor belt of reversible type and including a horizontal stretch carrying the cigarettes arranged crosswise thereto in superposed layers, and moving between two vertical side walls on a supporting table, said horizontal cigarette-carrying stretch having fixed thereto a transverse partition wall extending upwardly between the two side walls and moving, through corresponding movements of the conveyor belt, alternately away from the inlet of the magazine (located at one end of the cigarette-carrying stretch of said conveyor belt) to increase the capacity of the magazine and store cigarettes, and toward the inlet of said magazine to reduce the capacity of the magazine and return said stored cigarettes.

When the magazines of the type specified above receive filter-tipped cigarettes, the various layers of cigarettes on the horizontal cigarette-carrying stretch of the conveyor belt are inclined transversely to said conveyor belt because the filter-equipped end of each cigarette has a slightly larger diameter than the opposed end that is not provided with a filter. Inasmuch as the filter-tipped cigarettes of all the layers of cigarettes in the buffer magazine are directed in the same direction, the farther from the base (or horizontal cigarette-carrying stretch) they are, the steeper is their inclination transversely to the conveyor belt. When many layers of cigarettes are built up, the inclined cigarettes, especially in the upper layers, could slip down and fret with their ends remote from the filters against the respective vertical side wall of the buffer magazine. This fretting is also induced by possible side-skid movements of the horizontal cigarette-carrying stretch of the conveyor belt, said side-skid movements occurring more frequently upon changes of direction of the conveyor belt. The fretting of the lower ends of the inclined cigarettes against the respective side wall of the buffer magazine could damage the cigarettes and could brake the respective ends of the cigarettes during the longitudinal filling and emptying movements of the buffer magazine to such an extent as to turn the cigarettes askew or parallel to the longitudinal direction of the conveyor belt, with resulting disturbance in the operation.

This invention avoids this drawback by providing a supporting table, for the horizontal cigarette-carrying stretch of the conveyor belt, which is inclined or adapted to be inclined with respect to the horizontal transversely to the longitudinal direction of said cigarette-carrying stretch, and oppositely to the transverse inclination which the filter-tipped cigarettes tend to assume on said cigarette-carrying stretch, so as to ensure an average compensation for said inclination and to eliminate or at least minimize the inclination of the cigarettes in the upper layers.

Preferably, the transverse inclination of the supporting table for the horizontal cigarette-carrying stretch is regulatable to suit the changing inclination of the filter-tipped cigarettes and/or the number of superposed layers of filter-tipped cigarettes stored in the buffer magazine, or to arrange said supporting table horizontally when the buffer magazine is to receive cigarettes with no filter, which cigarettes will not become inclined transversely to the conveyor belt.

The invention provides also guide means to avoid any side skid or tilt of the cigarette-carrying stretch of the conveyor belt with respect to the supporting table even when the latter is inclined. In a preferred embodiment, said guide means comprises at least one longitudinal rib on the undersurface of the cigarette-carrying stretch of the conveyor belt, which is engaged in a corresponding longitudinal groove in the upper surface of the supporting table, or vice-versa.

According to another feature of the invention, the transverse partition wall fixed to the horizontal cigarette-carrying stretch of the conveyor belt is movable therewith, is pivotably connected to said belt on an axis extending longitudinally thereof, whereby it can be inclined transversely to the conveyor belt oppositely to the transverse inclination of the supporting table so that its side edges can be maintained parallel to the two vertical side walls of the buffer magazine. This permits the use of a transverse partition wall of a width substantially corresponding to the distance between the two side walls of the magazine.

According to another feature of the invention, inasmuch as the transverse inclination of the supporting wall causes a corresponding inclination of the horizontal cigarette-carrying stretch of the conveyor belt, at least the direction-changing roller for said belt at the inlet of the buffer magazine is also adapted to be inclined transversely similarly to the supporting wall.

These and other features of the invention and the advantages resulting therefrom will be apparent from the following description of a preferred embodiment thereof, shown by way of non-limitating example in the accompanying drawings, wherein:

DESCRIPTION OF THE PREFERRED EMBODIMENT

Figure 1:
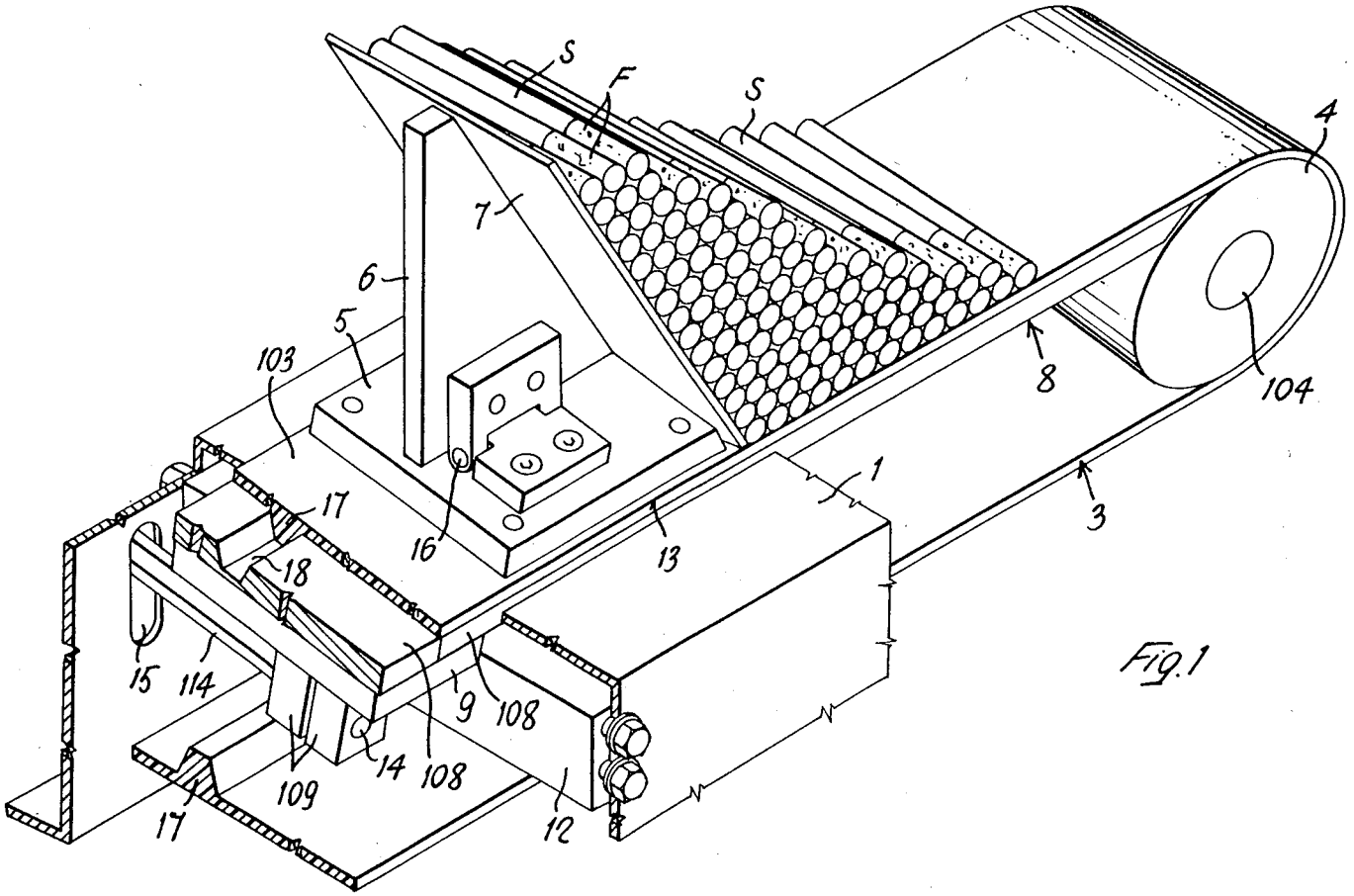
FIG. 1 is a perspective view of a portion of a buffer magazine according to the invention, shown as a vertical section made behind the transverse movable partition wall.

The illustrated buffer magazine is inserted in a cigarette-supplying installation between one or more cigarette-making machines and one or more cigarette-packing machines. The inlet into the magazine, where the latter communicates with a generally vertical passage for the cigarettes, is at the right-hand portion of FIG. 1. The buffer magazine comprises a substantially horizontal beam 1 having an inverted flanged U-shape, supporting two vertical, preferably transparent side walls 2 which are omitted in FIG. 1. The distance between the vertical side walls 2 is slightly larger than the length of a cigarette, for example according to the ratio shown in FIG. 2.

In the lower portion of the space defined by the two side walls 2, between these walls, is located the substantially horizontal stretch 103 of a conveyor belt 3 passed around suitable direction-changing rollers, of which only the roller 4 is shown in FIG. 4 as located at the end of the horizontal stretch 103 of the conveyor belt at the inlet of the buffer magazine. The horizontal stretch 103 of the conveyor belt 3, therefore, forms the bottom of the buffer magazine and supports the cigarettes S stored in this magazine between the two vertical side walls 2 thereof and arranged with their longitudinal axes transverse to the longitudinal direction of the horizontal stretch 103 of the conveyor belt 3. The horizontal stretch 103 of the conveyor belt 3 has affixed thereto, by means of a baseplate 5 and an upright member 6, a transverse partition wall 7 extending upwardly between the two side walls 2.

The cigarettes S contained in the buffer magazine are supported on the horizontal cigarette-carrying stretch 103 of the conveyor belt 3, between the transverse partition wall 7 affixed to said stretch 103 and the inlet into the magazine at the direction-changing roller 4. The conveyor belt 3 is actuated by reversible actuating means (not shown) and may be moved selectively in either direction. In order to store cigarettes into the buffer magazine, the transverse partition wall 7 is displaced, together with the horizontal cigarette-carrying stretch 103 of the conveyor belt, away from the inlet into the magazine (toward the left in FIG. 1), thus increasing the capacity of the buffer magazine. On the other hand, by displacing the transverse partition wall 7, by means of the horizontal cigarette-carrying stretch 103 of the conveyor belt 3, toward the inlet of the buffer magazine (toward the right in FIG. 1), the capacity of the magazine is reduced and the previously stored cigarettes S are discharged.

The horizontal cigarette-carrying stretch 103 of the conveyor belt 3 is supported by a supporting table 8 extending longitudinally of said stretch 103 of the conveyor belt and adapted to be inclined transversely. Specifically, in the illustrated embodiment, the supporting table 8 is comprised of aligned sections 108 which are fixed at the ends thereof, by means of screws 10, to supporting plates 9 which are, in turn, fixed by means of an underlying clamp member 109, each to a pivot 11 extending longitudinally of the cigarette-carrying stretch 103 of the conveyor belt 3 and fixed in cantilever fashion to an inside transom 12 of the beam 1. The sections 108 of the supporting table 8 and the respective supporting plates 9 protrude into the space between the side walls 2 of the magazine through a corresponding opening 13 in the beam 1. The clamp member 109 of each supporting plate 9 may be either slackened or tightened by means of a screw 14 comprising a co-axial extension of other-than-round configuration, for example of hexagonal configuration. The extensions 114 of the screws 14 are passed outside the beam 1 through corresponding vertically elongated slots 15 in the respective side wall of said beam 1.

By slackening the clamps 109 of the supporting plates 9, for example by a suitable wrench acting externally on the extensions 114 of the screws 14, and by angularly displacing the supporting plates 9, by means of the same extensions 114 of the screws 14, around the respective longitudinal fixed pivots 11, and then by tightening the clamps 109 again so as to lock the supporting plates 9 in the selected angular position on the pivots 11, the supporting table 8 of the cigarette-carrying stretch 103 can be inclined transversely to the conveyor belt 3 in a continuous manner within certain limits.

Figure 2:
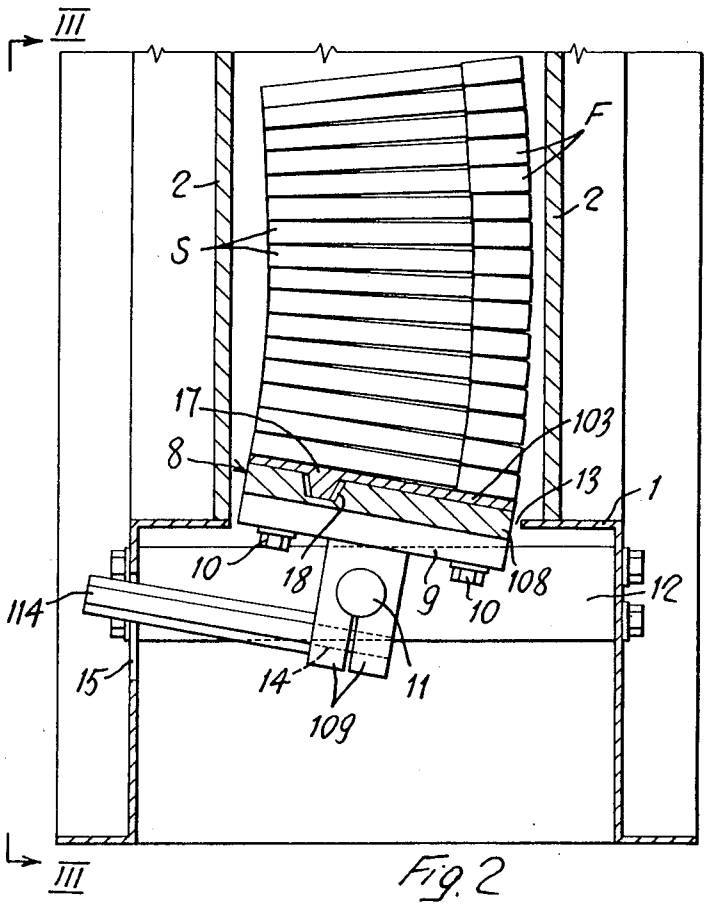
FIG. 2 is a vertical sectional view of the buffer magazine of FIG. 1.
Figure 3:
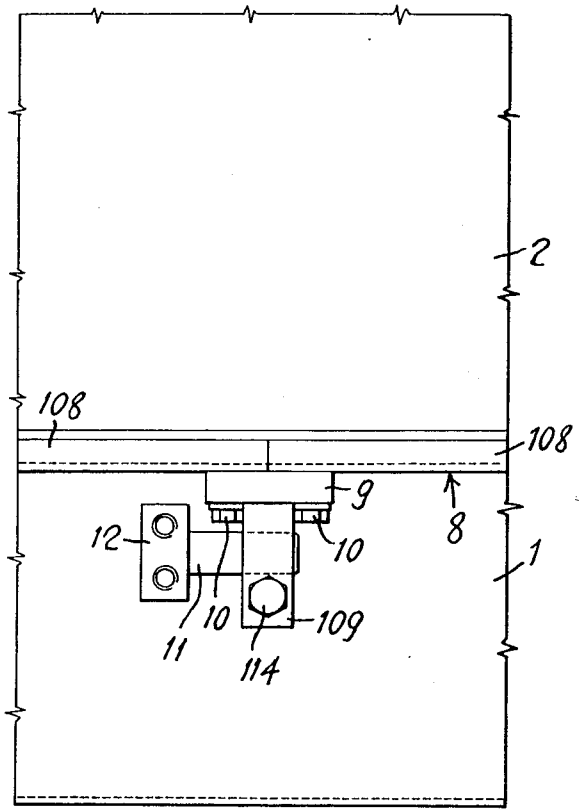
FIG. 3 is a side view thereof in the direction of the arrows III—III of FIG. 2.

When the buffer magazine is to be used with filter-less cigarettes, the supporting table 8 for the cigarette-carrying stretch 103 of the conveyor belt 3 is disposed and locked in a transversely horizontal position since both ends of these cigarettes have the same diameter and, therefore, the various layers of cigarettes in the buffer magazine will be substantially horizontal transversely to the cigarette-carrying stretch 103 of the belt. However, in case of filter-tipped cigarettes, the filter-equipped end of which has a slightly larger diameter than the filter-less end thereof, the cigarettes S of the various layers in the buffer magazine tend to assume a transversely inclined position to the cigarette-carrying stretch 103 of the conveyor belt 3, the filter-less ends of the cigarettes being directed downwardly of an extent which is proportional to their distance from the base. Therefore, in case of filter-tipped cigarettes, the supporting table 8 and, therefore, the cigarette-carrying stretch 103 of the conveyor belt 3 will be inclined as described above and oppositely to the inclination which the superposed layers of filter-tipped cigarettes tend to assume. This inclination of the supporting table 8 and cigarette-carrying stretch 103 is such as to compensate for the average opposite inclination of the various superposed layers of filter-tipped cigarettes, and to prevent the cigarettes built up in the buffer magazine from fretting with either of their ends against the vertical side walls 2. For example, an arrangement of the superposed layers of cigarettes can be obtained as shown in FIG. 2.

To permit the above inclination of the supporting table 8 together with the cigarette-carrying stretch 103 of the conveyor belt 3 while maintaining the width of the transverse partition wall 7 substantially equal to or just slightly smaller than the distance between the two side walls 2 of the buffer magazine, said transverse partition wall 7 is also connected to the cigarette-carrying stretch 103 of the belt 3 so as to be transversely inclined, whereby—when the supporting table 8 and cigarette-carrying stretch 103 will be inclined—the transverse partition wall 7 may be inclined in the opposite direction so that its side edges will be constantly parallel to the two vertical side walls 2. For this purpose, in the embodiment shown in FIG. 1, the transverse partition wall 7 is only secured to the upright member 6 and extends downwards in front of the front edge of the base plate 5, and is freely movable with respect thereto. However, the upright member 6 is secured to the base plate 5 by means of a hinge having a pivot 16 extending longitudinally of the cigarette-carrying stretch 103 of the belt and, therefore, it can be inclined transversely together with the transverse partition wall.

In order to avoid any side skid or tilt of the cigarette-carrying stretch 103 of the conveyor belt 3 with respect to the inclined supporting table 8, the belt 3 is provided with at least one longitudinal rib 17 slidably engaged in a corresponding longitudinal groove 18 formed in the upper surface of the supporting table 8. The direction-changing rollers 4 of the conveyor belt 3 are provided with similar annular grooves which are engaged by the longitudinal rib 17 of the belt 3. Obviously, the rib 17 of the conveyor belt 3 and the corresponding groove 18 in the supporting table 8 may be replaced by any other suitable longitudinal guide means ensuring any interengagement between the horizontal cigarette-carrying stretch 103 of the conveyor belt 3 and the supporting table 8, such as to avoid any transverse relative displacements between said stretch 103 and table 8.

Preferably, the shaft 104 of the direction-changing roller 4 for the conveyor belt 3 at the inlet into the buffer magazine, is also adapted to be inclined transversely to the longitudinal direction of the conveyor belt 3 by any suitable means, not shown because obvious to those skilled in the art. The shaft 104 of the roller 4 will be, therefore, inclined transversely to an extent corresponding to the transverse inclination of the supporting table 8 for the cigarette-carrying stretch 103 of the conveyor belt 3.

Of course, the invention is not limited to the embodiment here shown and described, but broad changes and modifications can be made thereto, especially of constructional nature, and specifically concerning the construction of the means for effecting the inclination of the supporting table, transverse partition wall and direction-changing roller or rollers. Moreover, the invention may be applied to buffer magazines for any rod-like articles other than filter-tipped cigarettes, though similar thereto, i.e. articles entailing similar problems in the buffer magazines of the type described in the preamble.

What I claim is:

1. In a buffer magazine for installations supplying rod-like articles, particularly supplying filter-tipped cigarettes from one or more cigarette-making machines to one or more packing machines, said buffer magazine including a reversible conveyor belt having a horizontal linear stretch carrying the cigarettes arranged crosswise thereto in superposed layers, and moving between two vertical side walls on a supporting table, said horizontal cigarette-carrying stretch of the belt having affixed thereto a transverse partition wall extending upwardly between the two side walls and moving, through corresponding movements of the conveyor belt, alternately away from the inlet of the magazine, located at one end of the cigarette-carrying stretch of the conveyor belt, to increase the capacity of the magazine and store cigarettes, and toward the inlet of the magazine to reduce the capacity of said magazine and return stored cigarettes, the improvement comprising: means for selectively inclining the supporting table (8) of the horizontal cigarette-carrying stretch (103) of the conveyor belt (3) with respect to the horizontal plane transversely to the longitudinal direction of said cigarette-carrying stretch (103) of the belt (3) in a direction opposite to the transverse inclination which the filter-tipped cigarettes tend to assume on said cigarette-carrying stretch (103) of the belt (3), so as to ensure an average compensation for said inclination.

2. A magazine according to claim 1, wherein said means for selectively inclining comprises means for regulating the transverse inclination of the supporting table (8) of the horizontal cigarette-carrying stretch (103) of the conveyor belt (3).

3. A magazine according to claim 1, wherein said means for selectively inclining comprises support members (9) on which said supporting table (8) is fixed, fixed pivots (11) extending longitudinally of said supporting table (8), and clamps mounting said support members on said pivots in an angularly regulatable manner.

4. A magazine according to claim 1, further comprising longitudinal movement guides provided between the supporting table (8) and the cigarette-carrying stretch (103) of the conveyor belt (3), said guides preventing the cigarette-carrying stretch (103) of the belt (3) from displacing transversely to said supporting table (8).

5. A magazine according to claim 4, wherein at least the horizontal cigarette-carrying stretch (103) of the conveyor belt (3) comprises at least one longitudinal rib (17) on the undersurface thereof which is slidably engaged with a corresponding longitudinal groove (18) in the upper surface of the supporting table (8), or vice-versa.

6. A magazine according to claim 1, wherein the transverse partition wall (7) is pivotably connected to the horizontal cigarette-carrying stretch (103) of the conveyor belt (3) on an axis (16) extending longitudinally of said cigarette-carrying stretch (103), whereby it can be inclined transversely to the belt in a direction opposite to the inclination of the supporting table (8) to maintain the two side edges thereof parallel to the two vertical side walls (2) of the buffer magazine.

7. A magazine according to claim 1, further comprising a direction-changing roller (4) for the conveyor belt (3) at the inlet of the magazine, said roller being adapted to be inclined with its axis (104) transversely to said belt (3) in the same direction as the supporting table.

* * * * *